United States Patent [19]

Nausedas

[11] 4,085,878

[45] Apr. 25, 1978

[54] DISPENSER-CUTTER FOR TACKY FABRIC MATERIALS

[75] Inventor: Joseph Anthony Nausedas, Chicago, Ill.

[73] Assignee: Union Carbide Corporation, New York, N.Y.

[21] Appl. No.: 766,472

[22] Filed: Feb. 7, 1977

[51] Int. Cl.[2] ..... B26F 3/02

[52] U.S. Cl. ..... 225/19; 225/89

[58] Field of Search ..... 225/19, 20, 89

[56] References Cited

U.S. PATENT DOCUMENTS

| | | | |
|---|---|---|---|
| 2,798,552 | 7/1957 | Aldrich | 225/19 |
| 2,954,910 | 10/1960 | Moncrieff | 225/20 |
| 3,731,863 | 5/1973 | Nausedas | 225/20 |

*Primary Examiner*—J. M. Meister

*Attorney, Agent, or Firm*—Maurice W. Ryan

[57] ABSTRACT

An improved dispenser-cutter for rolled fabric materials, particularly tacky materials such as wax-impregnated fibrous paper, which comprises a cutting blade mounted on a slideable carriage reciprocally movable between cutting and retracted positions, the carriage including roller elements arranged to guide the material to the cutting disposition, hold it during cutting action, free it from the cutting blade and position it against snap back after the cutting action, for easy safe access.

8 Claims, 3 Drawing Figures

FIG. 2
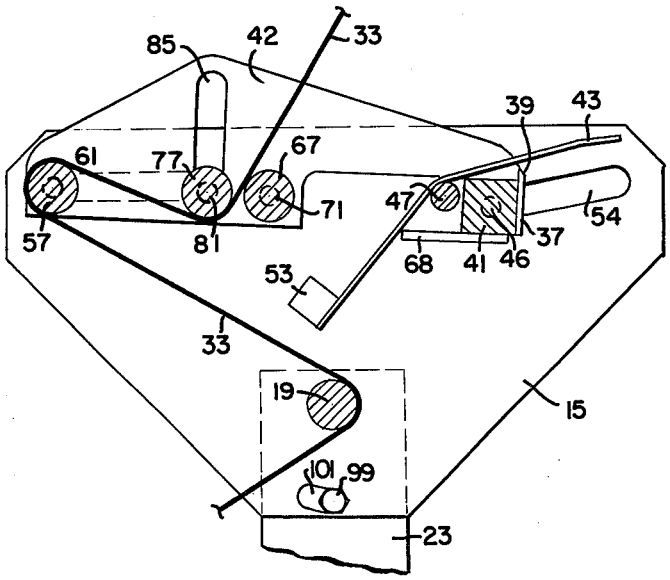
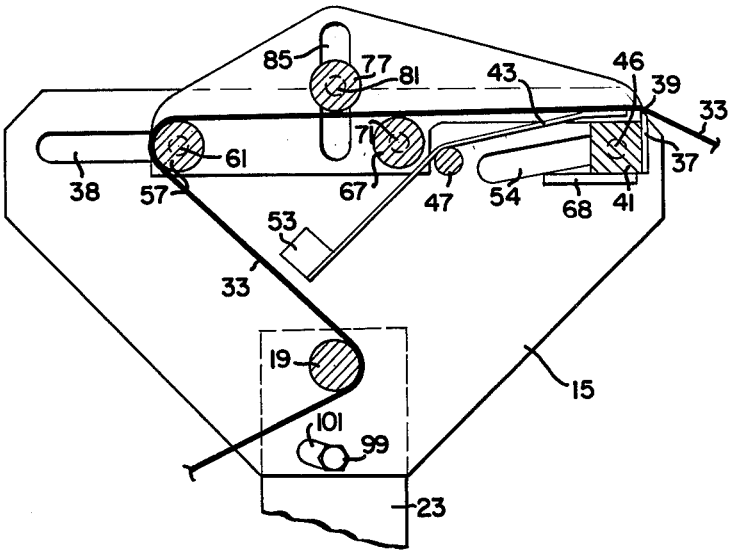
FIG. 3

DISPENSER-CUTTER FOR TACKY FABRIC MATERIALS

The present invention relates to improved apparatus for dispensing and cutting desired lengths of fabric material from a roll of such material, and more particularly to apparatus for so dispensing and cutting tacky fabric materials, such as, for example, wax impregnated papers used to shield sharp bone ends and edges in the meat packing industry.

The food packaging industry in general and meat packing operations in particular require the use of tacky fabric wrapping materials in the course of packaging operations. In the packaging and/or bagging of primal cuts and some retail size cuts of meat for instance where the outer packaging material or wrapping is frequently some form of plastic film or the like, which is also quite frequently heat shrunk on the article, one or more layers of wax impregnated heavy web textured paper are used to cover projecting bone parts and sawed ends of bone which tend to tear and destroy the integrity or otherwise reduce the effectiveness of the outer wrapping material. The tacky web wax impregnated materials are known generally in the trade as "bone wrap." The problems occasioned by the use of bone wrap materials in the meat packing industry are many, since the meat pieces, particularly primal cuts, being packaged are not identical in size, shape and/or weight and require the application of the bone wrap in varying numbers of pieces and sizes to accommodate the assorted forms of bone projection, sawed bone ends or whatever encountered in the course of routine packing operations.

Meat packing involving the use of bone wrap materials is further complicated in that the operations are usually performed in a low temperature atmosphere or cold room and the substances used to impregnate the bone wrap, wax for instance, tend to become viscous and stiff and agglomerate on the severing edges of the cutting blade apparatus. This of course necessitates periodic cleaning of the bone wrap dispenser cutter equipment accompanied by dismantling and reassembly of the equipment components.

The bone wrap is not suitable for precutting and stacking in the cold rooms because its tackiness makes stacked sheets stick together and because so many different random sizes are needed in ordinary operations. The cored spool or roll of bone wrap has thus gained acceptance in such operations, but up to time of the present invention no completely satisfactory dispenser cutter equipment has been available to industry for holding, dispensing and cutting the bone wrap at low temperature conditions. In my earlier patent, U.S. Pat. No. 3,731,863, issued May 8, 1973, I described a dispenser-cutter apparatus which solved a good many of the problems attending the dispensing and cutting of lengths of bone wrap material in cold room operations. The invention described herein is an improved dispenser-cutter for bone wrap materials, involving different operating principles and different combined elements the more efficaciously to attain the desired results.

With this then being the state of the art, the present invention was conceived and developed having as an object the provision of an improved dispenser cutter apparatus for rolled fabric materials including a broad range of material characteristics.

Another object of the invention is to provide apparatus uniquely suitable for holding, dispensing and cutting tacky fabric materials such as wax impregnated bone wrap used in meat packing operations.

Still another object of the invention is to provide a bone wrap dispenser cutter apparatus easily used in low temperature atmospheres.

A still further object of the invention is to provide a bone wrap dispenser cutter which is easy to disassemble, either completely or in part, clean of agglomerated materials, and reassemble.

It is a still further and important object of this invention to provide a bone wrap dispenser cutter having cutting blade guard means which protects against injuries while the apparatus is at rest and while it is in use.

A further object is to provide a dispenser cutter which, after a tearing operation to yield a selected length of bone wrap, retracts to a position wherein a bone wrap material edge area or leader of material from the material roll, is readily reached for grasping and pulling the next selected length for cutting, and which operably assures against retraction of the leader back into an inaccessible or difficult to reach position in the apparatus.

It is also an object of this invention to provide bone wrap dispenser cutter apparatus which comprises a minimum of relatively simple parts which coact to produce the desired results, without reliance on complex intricate components (or even springs) and/or operating principles, and which functions continually and reliably with consistently reproducible results over extended operating periods.

In general, the present invention comprehends apparatus for dispensing random length cut pieces from a supply of continuous length fabric product, comprising, in combination: a fixed frame provided with a pair of side plates disposed in a fixed parallel juxtaposed generally vertical orientation each with respect to the other, separated by a distance greater than the width of the fabric product to be dispensed; a moveable carriage disposed between the frame side plates and arranged and adapted to move reciprocally in a generally horizontal locus between first and second positions relative to the fixed frame, having carriage side plates arranged and disposed in parallel relationship each with respect to the other and generally parallel to the frame side plates, separated by a distance greater than the width of the fabric product to be dispensed; fabric cutting blade means on the moveable carriage mounted with a blade cutting edge upwardly oriented transversely of and extending between proximal ends of the carriage side plates; first roller means extending transversely between distal ends of the carriage side plates; second roller means extending transversely between the carriage side plates at a location between the proximal and the distal ends thereof; third roller means extending transversely between the carriage side plates at a location between the first roller means and the second roller means, moveable reciprocally vertically with respect to said carriage side plates between a first position in which it will depress fabric spanning the first and second roller means when the moveable carriage is in its first position, and a second position to which it is urged by tensioned fabric when the carriage is in its second position; and cutting blade guard means mounted transversely of the fixed parallel side plates, arranged and disposed to shield the fabric cutting blade cutting edge when the carriage is in its first position.

The foregoing and other objects, advantages and features of the invention will be the more readily understood and appreciated in the light of the ensuing detailed description and the drawing, wherein:

FIG. 2 is a partially schematic side elevation view of the apparatus of FIG. 1, shown with the moveable carriage portion of the apparatus in retracted position; and FIG. 3 is a partially schematic side elevation view of the apparatus of FIG. 1, shown with the moveable carriage portion of the apparatus in extended position.

Figure 1:
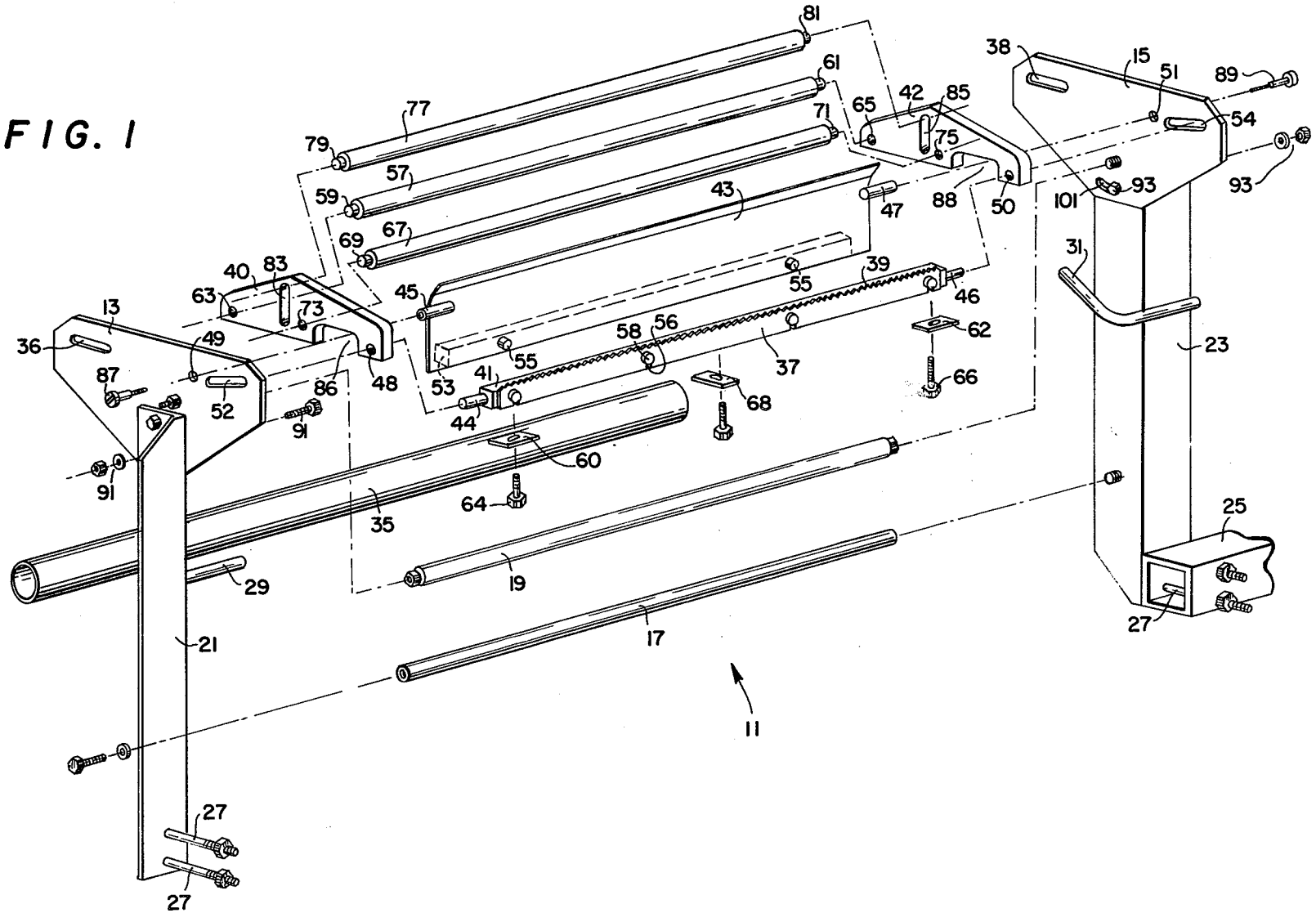
FIG. 1 is a perspective view of an exploded assembly of apparatus according to the invention.

With reference to the drawings, FIG. 1 shows an assembly of apparatus 11 according to the invention comprising side plates 13, 15 drilled and slotted to accommodate the various elements hereinafter described and mounted atop angle iron stanchions 21, 23, disposed and held in juxtaposed parallel relationship by lateral bar assemblies 17, 19, or their equivalents, the whole of these components secured to a mounting frame shown partially as a channel member 25 by means of bolts 27 or the like fastening means. Bracket arms 29, 31 are attached to the stanchions 21, 23 by welding or the like as shown to provide for the rotatable mounting of a spool shaft 35 which carries the roll of tacky web or whatever material 33 to be dispensed.

A moveable carriage assembly is arranged and disposed inwardly of the parallel arrayed side plates and stanchions and comprises carriage side plates 40, 42 drilled, notched, and slotted as shown to accommodate the various elements hereinafter described. Forward on the paired carriage side plates 40, 42, that is to say towards the viewer of FIG. 1, at what, for convenience, will be called the carriage side plates proximal ends, a cutting blade 37 provided with a serrated edge 39 is mounted on a blade holder 41. Blade holder 41, as shown, is square or rectangular in cross section and has turned down ends forming hubs 44, 46 which extend through holes 48, 50 in the carriage side plates 40, 42 and into slideable engagement with slots 52, 54 in the side plates 13, 15. The blade 37 is mounted on its blade holder 41 so as to be readily removeable by means of blade slots 56 engaging bosses 58 on the blade holder 41, and is maintained against rotation on its hubs 44, 46 by means of stabilizing tabs 60, 62, fastened to the cutting blade holder 41 at the underside ends thereof with machine screws 64, 66 or the like means, and arranged to bear against the underside proximal edges of the carriage side plates. A third tab 68, similar to the stabilizing tabs 60, 62, is attached to the mid-point underside of the holder 41 and projects rearwardly towards the distal end of the apparatus to serve as a stop for the blade guard mechanism, as will be more fully described hereinafter.

A first roller 57 is mounted transversely of the paired carriage side plates, parallel to the cutting blade assembly, aft on the apparatus, that is to say away from the viewer of FIG. 1, at what, for convenience, will be called the carriage side plates distal ends. Roller 57 has turned down ends forming hubs 59, 61 which extend through holes 63, 65 in the carriage side plates 40, 42 and into slideable engagement with slots 36, 38 in the side plates 13, 15.

Thus it will be understood at this point in the description of the invention that the slideable engagement of the blade holder hubs 44, 46 with side plate slots 52, 54 and of first roller hubs 59, 61 with side plate slots 36, 38, determines the locus and the limits of travel of the moveable carriage assembly with respect to the fixed frame portions of the apparatus.

A second roller 67 is also located transversely between the carriage side plates 40, 42, parallel with the first roller and the cutting blade, rotatably mounted by means of its turned down ends hubs 69, 71, in holes 73, 75 in the carriage side plates. Unlike the blade holder hubs and the first roller hubs, the second roller hubs 69, 71 do not extend beyond the carriage side plates outer lateral surfaces to any extent to effect any working contact with the fixed side plates 13, 15.

A third roller 77, called a dancer roller, is located between the first and second rollers, parallel in relationship to them and to the cutting blade and extending transversely of the carriage side plates 40, 42. The dancer roller 77 is provided with turned down ends forming hubs 79, 81 which engage and slideably move in vertical slots 83, 85 in the carriage side plates.

A blade guard 43 is located at the fore or proximal end of the apparatus, transversely disposed between the side plates 13, 15 and pivotally mounted by means of journal pins 45, 47 riding in holes 49, 51 in the side plates 13, 15. A counterweight 53 is attached to the trailing or distal edge of the blade guard 43 by means of rivets 55 or the like fasteners to keep the blade guard braced at a predisposed tilt relative to the cutting blade which it shields. The journal pins 45, 47 as shown in FIG. 1 of the drawing, may be drilled and tapped to accommodate Dardalet machine screws 87, 89, the solid shank portions of which serve nicely to reinforce the bearing points for the pivotal mounting of the blade guard 43 in the side plate holes 49, 51. The carriage side plates 40, 42 are notched as at 86, 88 to make a clearance accommodation.

The manner in which the side plates 13, 15 attach to the stanchions 21, 23 is important to the invention. Primary connection is effected by the lateral support bar assembly 19, which, with its related end fasteners of whatever nature, serves to attach side plate 13 to stanchion 21, side plate 15 to stanchion 23, and to establish and maintain the preselected separation distance of these assemblies. Secondary connections are provided by bolting assemblies 91, 93 disposed respectively in a hole 95 in stanchion 21 and a registering arcuate slot 97 in side plate 13, and in a hole 99 in stanchion 23 and a registering arcuate slot 101 in side plate 15. This arrangement permits the entire carriage assembly as it is mounted in the side plates 13, 15, to be tilted relative to horizontal and thus adjusted and locked in a selected position so that the apparatus at rest will reside in its first or retracted position by means of gravitational force.

FIG. 2 of the drawing shows a section through the above-described apparatus at rest in its retracted or first position. This view shows the manner in which the third tab 68 serves as a stop for the blade guard assembly, serving to keep it at the preselected height and tilt angle with respect to the cutting blade assembly which it shields.

To prepare the above-described embodiment of apparatus according to the invention for operation, a cored roll of material 33 to be dispensed in cut lengths is placed with the ends of its spool shaft 35 resting in bracket arms 29, 31 with the material lead direction from the roll upperside towards the distal end of the machine. The material 33 is threaded around and over the upper surface of first roller 57, under the dancer roller, third roller 77, over the upper surface of second roller 67, and pulled through enough to provide a comfortably graspable leader with the dancer roller in its first or lower position. The apparatus of the invention in this condition is shown in FIG. 2 of the drawing.

FIGS. 2 and 3 of the drawing illustrate a typical operational sequence of the apparatus. With reference to FIG. 2, the leader of material 33 extending from between third or dancer roller 77 and second or fore roller 67 is grasped and pulled outwardly and upwardly towards the fore or proximal end of the machine, with the material's underside forward of the dancer roller held clear of contact with the apparatus components other than an initial relatively brief contact with a portion of the peripheral surface of fore roller 67. As the pulling action progresses, its direction is altered more towards the horizontal, the tensioned material 33 simultaneously raises the dancer roller 77 in its slots 83, 85 and pulls the entire carriage assembly forward in slots 52, 54, 36, 38 from its first or retracted position to its second, advanced or extended position, as shown in FIG. 3. At the initial stage of the operation, the material 33 underside is in contact only with the peripheral upper surface of aft or first roller 57 and the material upper surface is in contact with the peripheral underside of the dancer roller 77. The pulling action effects rotation of any rollers contacted by the material. Specifically, at the initial pull the first and second rollers rotate clockwise and the dancer roller rotates counterclockwise. When the material is pulled substantially in this initial upward and outward direction to a desired cutting length, pulling action is stopped but with tension maintained, and the material is directed downward to bring its underside into bearing contact on the uppermost leading edge of the blade guard 43. By this time in the pulling sequence the entire carriage will have advanced to its second position as shown in FIG. 3, and the blade cutting edge will be out from under the leading edge of the blade guard.

At the operational stage illustrated in FIG. 3, the material 33 is taut and substantially horizontal under the dancer roller 77, elevating the dancer roller to its uppermost working height or second position. As further shown in FIG. 3, the bearing action of the underside of the taut material 33 on the upper surface of the blade guard 43 pivots the blade guard assembly about its journals 45, 47 raising the counterweight 53 and aft end of the blade guard.

At this stage, with the material firmly on the cutting edge 39 of the blade 37, the cutting action is easily performed by exerting a firm downward pull while simultaneously applying a slight twist or warp to the material to initiate the tear into and through the material edge at one end or the other of the cutting blade.

Immediately as the severed piece of material 33 comes free of the cutting blade 37, ready for use, the tension in the material 33 between the supply roll and the cutting blade abates, permitting the dancer roller 77 to drop back to its initial or first position in the slots 83, 85, and, simultaneously, permitting the carriage assembly to slide back to its initial or first position. Concurrently, the blade guard assembly pivots upward and in the course of its travel pushes the material 33 off cutting blade 37 and frees the material to provide a new leading edge or leader thereof for next sequential dispensing and cutting operation.

The materials used in fabricating apparatus according to the invention are conventional, preferably stainless steel, monel metal or the like selected for ease of maintenance and cleaning as well as durability and strength and their particular selections are considered well within the ken of persons conversant with the art. The carriage side plates 40, 42 are made of nylon in the illustrated embodiment. It is possible if desired in given circumstances to spring load or otherwise bias load the moveable carriage assembly and the dancer roller in directions towards their respective first positions.

The components of the apparatus are assembled so as to be readily removeable to facilitate cleaning. The rollers may be in the form of hollow cylinders rotating on concentric shafts or may, as in the case of the illustrated embodiment, be machined from solid rod stock to make one piece rollers with integral turned down shaft ends. Bearings may be provided where necessary in particular applications and certain of the rollers may selectively incorporate one-way clutch mechanisms.

Various other alternative forms of the invention will, in the light of the foregoing description, undoubtedly occur to persons familiar with the art, such alternative forms being nonetheless within the spirit of this invention. It is intended therefore that this description be deemed illustrative only and not construed in any limiting sense.

What is claimed is:

1. Apparatus for dispensing random length cut pieces from a supply of continuous length fabric product, comprising, in combination:

a fixed frame provided with a pair of side plates disposed in a fixed parallel juxtaposed generally vertical orientation each with respect to the other, separated by a distance greater than the width of the fabric product to be dispensed;

a moveable carriage disposed between the frame side plates and arranged and adapted to move reciprocally in a generally horizontal locus between first and second positions relative to the fixed frame, having carriage side plates arranged and disposed in parallel relationship each with respect to the other and generally parallel to the frame side plates, separated by a distance greater than the width of the fabric product to be dispensed;

fabric cutting blade means on the movable carriage mounted with a blade cutting edge upwardly oriented transversely of and extending between proximal ends of the carriage side plates;

first roller means extending transversely between distal ends of the carriage side plates;

second roller means extending transversely between the carriage side plates at a location between the proximal and the distal ends thereof;

third roller means extending transversely between the carriage side plates at a location between the first roller means and the second roller means, moveable reciprocally vertically with respect to said carriage side plates between a first position in which it will depress fabric spanning the first and second roller means when the moveable carriage is in its first position, and a second position to which it is urged by tensioned fabric when the carriage is in its second position; and cutting blade guard means mounted transversely of the fixed parallel side plates, arranged and disposed to shield the fabric cutting blade cutting edge when the carriage is in its first position.

2. Apparatus according to claim 1 in combination with holding means to rotatably mount a roll of fabric product transversely of the side plates with the longitudinal axis of the roll in a position below the longitudinal axis of the first roller means.

3. Apparatus according to claim 1 wherein the cutting blade guard means is pivotally mounted on the side plates and pivotally moveable between a first position corresponding to the first position of the moveable carriage wherein it shields the cutting blade means cutting edge and a second position corresponding to the second position of the moveable carriage wherein the cutting edge of said cutting blade means is unshielded.

4. Apparatus according to claim 3 in combination with means to bias said cutting blade guard means towards it first position.

5. Apparatus according to claim 1 in combination with roller control means adapted to permit roller rotation only in the direction of fabric advance from a fabric supply roll.

6. Apparatus according to claim 1 with said cutting blade guard means movably mounted transversely of the frame side plates, arranged and disposed to shield the fabric cutting blade cutting edge when the carriage is in its first position, and to expose said cutting edge when the carriage is in its second position and tensioned fabric impinges downwardly on said blade guard means.

7. Apparatus according to claim 1 wherein the second position of the third roller means is above the third position of said third roller means.

8. Apparatus according to claim 1 wherein the vertical movement of the third roller means is proscribed by slots in said movable carriage side plates.

* * * * *